United States Patent [19]

Hansen et al.

[11] Patent Number: 4,898,331

[45] Date of Patent: Feb. 6, 1990

[54] ATOMIZER WHEEL WITH BUSHINGS OF DIFFERENT INWARDLY PROTRUDING LENGTHS

[75] Inventors: Ove E. Hansen, Columbia; Christopher P. Healy, Ellicott City, both of Md.

[73] Assignee: A/A Niro Atomizer, Soeborg, Denmark

[21] Appl. No.: 288,178

[22] Filed: Dec. 22, 1988

[51] Int. Cl.[4] ..... B05B 3/10

[52] U.S. Cl. ..... 239/223

[58] Field of Search ..... 239/223, 224

[56] References Cited

U.S. PATENT DOCUMENTS

| | | | |
|---|---|---|---|
| Re. 30,963 | 6/1982 | Moller et al. | 239/224 |
| Re. 32,064 | 1/1986 | Nielsen | 239/224 |
| 3,887,133 | 6/1975 | Straarup et al. | 239/224 |
| 4,303,200 | 12/1981 | Hansen | 239/223 |
| 4,684,065 | 8/1987 | Svarrer | 239/224 |

*Primary Examiner*—Andres Kashnikow
*Assistant Examiner*—Karen B. Merritt
*Attorney, Agent, or Firm*—Armstrong, Nikaido Marmelstein, Kubovcik & Murray

[57] ABSTRACT

An atomizer wheel for the atomization of slurries of highly abrasive materials which includes a hub secured to a rotating shaft, a wheel bottom connected to the hub, a cylindrical side wall connected with the wheel bottom and a cover plate to form a bowl-shaped feed supply chamber. The side wall includes a number of openings fitted with bushings to provide nozzles which eject droplets of a suspension or slurry provided to the bowl-shaped feed supply chamber. The inner end of each of the bushings extend inwardly from the side wall of the wheel and the inner end or at least a portion of the inner end of at least one of the bushings extends radially inwardly from the side wall a greater distance than the inwardly extending ends of other bushings.

26 Claims, 2 Drawing Sheets

FIG. 1
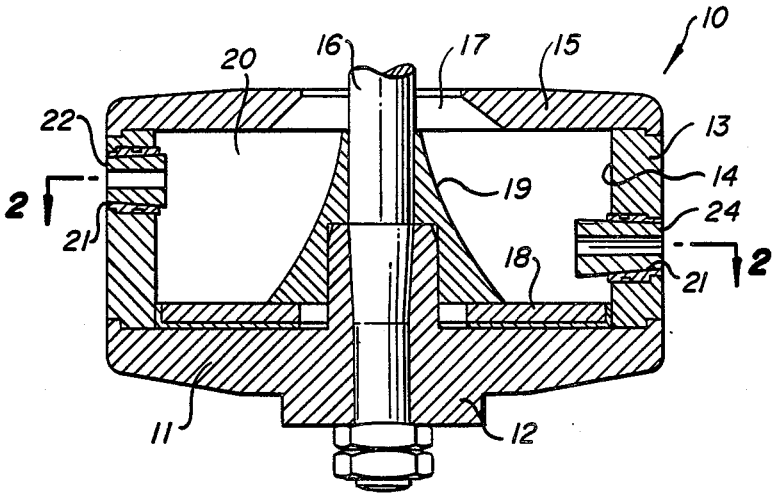
FIG. 2
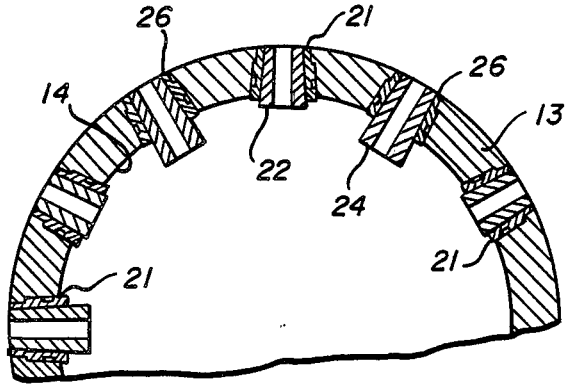
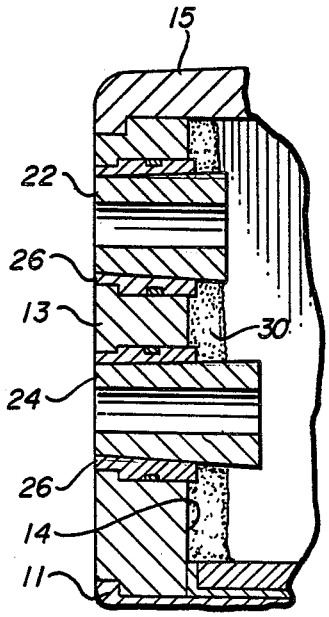
FIG. 3

ATOMIZER WHEEL WITH BUSHINGS OF DIFFERENT INWARDLY PROTRUDING LENGTHS

The present invention is directed to an atomizer wheel for the atomization of feed liquids and suspensions and, more specifically, to an atomizer wheel for the atomization of suspensions or slurries of highly abrasive materials such as a cement slurry or slurries of clay, ore concentrates or other materials.

BACKGROUND OF THE INVENTION

Atomizer wheels of the type used for the atomization of slurries of highly abrasive materials are comprised of a hub secured to a rotating shaft, a wheel bottom connected to the hub, a cylindrical side wall connected with the wheel bottom and a cover plate to form a bowl-shaped feed supply chamber. The feed supply communicates with an inlet in the cover plate for a liquid suspension or slurry to be atomized. The side wall typically has at least one row of openings fitted with nozzles frequently in the form of bushings which eject droplets of the suspension or slurry from the bowl-shaped chamber.

The process of spray drying liquids and solids in liquid suspensions is critically dependent upon the means used to form small droplets of the feed material so as to facilitate vaporization of the liquid carrier. For purposes of the present invention, the term atomization is used to describe the formation of small droplets.

Various liquids and various solids in a liquid suspension require specific handling in a spray drying process. The specific design and operation of an atomizer wheel are critical functional and economic factors in spray drying operations. Atomization of suspensions of abrasive materials has long been recognized as a critical problem in spray drying operations particularly when processing abrasive materials at high wheel loadings. Equipment failure due to the action of the abrasive materials at points of wear on the atomizer wheel interrupts process operation and requires costly equipment replacement.

Various measures have previously been suggested to reduce the undesirable abrasive action in atomizer wheels. U.S. Pat. No. Re 32,064 describes an atomizer wheel comprising an annular chamber provided with a number of conical outlet holes lined with bushings to provide nozzles having their inner ends extending a distance into the interior of the chamber. Each of the outlet holes is lined with a bushing formed of a wear-resistant sintered material.

The use of replaceable steel bushings to seat wear-resistant ceramic linings in a number of ejection apertures or orifices along the circumference of an external wall of an atomizer wheel is described in U.S. Pat. No. Re 30,963. The inner end of the steel bushings and/or the linings project into the annular chamber of the atomizer wheel and the bushings are sealed against the external wall.

U.S. Pat. No. 4,684,065 describes an improved structure wherein each bushing is provided at its inner surface facing the wear-resistant lining with a flat recess permitting the steel bushing to be resiliently deformed without transferring excessive stress to the lining.

U.S. Pat. No. 3,887,133 describes an atomizer wheel comprising a number of ejection orifices and a number of spoke-like projections extending into the annular bowl-shaped space defined by the interior of the wheel.

In U.S. Pat. No. 4,303,200, an atomizer wheel is provided with a number of ejection orifices with each orifice including a bushing having a slit extending part way across the interior end of the bushing. The atomizer wheel described therein is directed to the atomization of non-abrasive solutions and is unsuited for suspensions or slurries of heavy abrasive products.

It is an object of the present invention to provide an atomizer wheel useful for the atomization of highly abrasive materials which has both improved resistance to abrasion, particularly when processing abrasives at high wheel loadings, and provides considerably increased capacity.

SUMMARY OF THE INVENTION

The atomizer wheel according to the present invention is comprised of a hub adapted for connection to a rotatable drive shaft, a bottom, a side wall, and a cover plate defining an annular bowl-shaped space concentric with the hub. The side wall is formed with a number of openings. A corresponding number of nozzles, usually bushings formed of a wear resistant material, are also provided with each bushing being inserted into one of the openings with one end of each bushing projecting into the bowl-shaped space a distance from the side wall. At least one of the bushings has at least a portion of the one end projecting into the bowl-shaped space a greater distance from the side wall than at least a portion of the corresponding ends of other bushings.

In a preferred embodiment, the entire one end of at least one of the bushings projects into the bowl-shaped space a greater distance from the side wall than the corresponding ends of other bushings.

The ejection orifices are preferably provided in at least one circular row around the side wall and a predetermined number of the bushings equally spaced around the side wall have one end projecting into the bowl-shaped space a greater distance than the other bushings.

In another embodiment, one end of at least one of the bushings is formed so that one part of the one end of that bushing projects inward a greater distance than another part of that end of the bushing.

In this embodiment the end of the bushing extending inward from the side wall may be stepped so that one part of the end projects inward a greater distance than another part.

In another embodiment the one end of at least one of the bushings may be tapered.

In each of the preferred embodiments the openings are provided in two circular rows and equally spaced around the side wall of the atomizer wheel and alternate ones of said bushings have at least a portion of one end projecting into the bowl-shaped space a greater distance from the side wall than the bushings adjacent thereto.

The advantages offered by the present invention are provided by the atomizer wheel structure wherein the nozzles or the bushings lining the nozzles do not all protrude the same effective distance into the bowl-shaped feed supply chamber of the atomizer wheel. During operation, the bushing or bushings extending the least effective distance into the bowl-shaped chamber determine(s) the maximum thickness of an abrasion protective layer formed by sedimented particles separated from the feed material by centrifugal force developed as a result of rotation of the atomizer wheel. The bushing or bushings extending a greater distance into the bowl-shaped chamber enhance acceleration of the feed material provided to the bowl-shaped chamber in direct proportion to the efficiency of the fluid/solid surface coupling of the fluid and the nozzle or bushing surface causing the acceleration.

It is known from U.S. Pat. No. 3,887,133 that a number of "spoke-like projections" sometimes called "paddlers" may be provided internally in an atomizer wheel to increase the production capacity of an atomizer wheel used in the atomization of highly abrasive materials. However, a serious drawback of the use of projections or paddlers as disclosed in U.S. Pat. No. 3,887,133 is that the paddlers are exchanged for nozzles and occupy certain of the ejection orifices in the side wall. The use of paddlers thus reduces the number of nozzles or bushings available in the wheel for atomizing the feed material.

The present invention teaches both nozzle types and nozzle arrangements that combine the ability to form a protective layer on the inner or side wall of the bowl-shaped feed chamber with increased pumping power and wheel production capacity without the use of separate paddlers.

In one embodiment of an atomizer wheel according to the present invention, at least one of the otherwise identical outlet nozzles protrudes inwardly from the side wall of the bowl-shaped chamber an effective distance greater than the other nozzles. In another embodiment of an atomizer wheel according to this invention at least one of the otherwise identical outlet nozzles protrudes inwardly from the side wall of the bowl-shaped chamber an effective distance which is less than the other nozzles.

The present invention and the advantages provided thereby will be more fully understood with reference to the following Detailed Description of the Preferred Embodiment taken in conjunction with the accompanying drawings.

BRIEF DESCRIPTION OF THE DRAWINGS

FIG. 1 is a vertical sectional view taken along an axial plane of an atomizer wheel constructed in accordance with the present invention;

FIG. 2 is a sectional view, partly broken away, taken along the line 2—2 of FIG. 1;

FIG. 3 is an enlarged sectional view of an outer side wall portion of the atomizer wheel of FIG. 1;

DESCRIPTION OF THE PREFERRED EMBODIMENT

Figure 5:
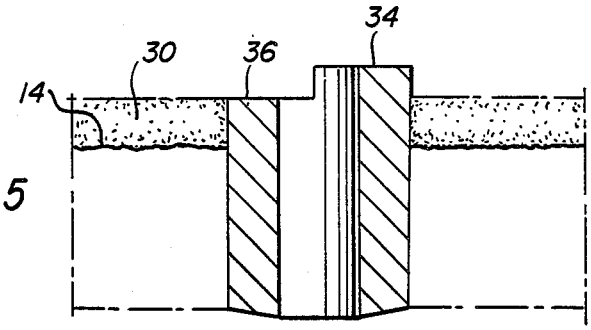
FIG. 5 is a sectional view, partly broken away, taken along the line 5—5 of FIG. 4.

With reference to the drawings wherein like reference numerals designate the same or like parts throughout, there is shown in FIGS. 1–3 an atomizer wheel generally designated by the reference numeral 10 and comprised of a bottom 11 with a central hub 12, a cylindrical side wall 13 having an inner surface 14 and a cover plate 15. The atomizer wheel 10 is secured in a conventional manner to a rotatable drive shaft 16.

The drive shaft 16 extends through a central bore formed through the cover plate 15 so as to form an annular opening 17 between the drive shaft and cover plate 15. The bottom 11, the internal surface 14 of the side wall 13 and the cover plate 15 define an annular bowl-shaped feed supply chamber 20 internally of the atomizer wheel 10.

The annular opening 17 serves as an inlet for the introduction of a slurry or feed material to the annular, bowl-shaped feed supply chamber 20.

An annular insert 18 of a wear-resistant material may be arranged in a known manner to cover the interior of the bottom 11 to protect the bottom against wear resulting from the highly abrasive slurry material. The cover plate 15 may be coated with a wear resistant material. A body 19 forming a guide surface for the slurry introduced through the annular opening 17 may also be arranged around the hub 19 in the interior of the wheel.

The side wall 13 is provided with a number of stepped bores or openings 21 extending therethrough. A nozzle in the form of a bushing 22 or 24 is provided in opening 21. The bushings 22 and 24 are substantially identical with the exception that the bushings 24 are longer than the bushings 22. The elements comprising the bushings 22 and 24 are formed from a wear-resistant sintered material and may be seated in the openings 21 by means of stainless steel sleeves as disclosed in U.S. Pat. No. 4,684,065.

The external end of each of the bushings 22 and 24 is substantially flush with the external surface of the side wall 13. The internal ends of each of the bushings 22 and 24 project or protrude radially inwardly from the interior surface 14 of the side wall 13. However, the internal end of the longer bushings 24 project into the bowl-shaped annular end 20 a greater distance from the side wall 13 than do the internal ends of the shorter bushings 22.

FIGS. 1–3 show an atomizer wheel structure typical of atomizer wheels used for the atomization of highly abrasive slurry materials wherein the openings 21 are arrayed in two spaced circular rows with 12 openings and nozzles in the form of bushings or inserts equally spaced around the circumference of the side wall 13 in each row. Thus, as shown in FIGS. 1–3, 12 equally spaced openings are provided in each row and the short bushings or inserts 22 are provided in every other ejection orifice 21 with the long bushings or inserts 24 provided in the openings 21 between the openings 21 mounting the short bushings 22.

The bushings 22 and 24 are seated in the openings 21 with the radially outer ends of the bushings 22 and 24 substantially flush with the external surface of the side wall 13. The radially inner ends of the bushings 22 and 24 project radially inwardly from the internal surface 14 of the side wall 13 into the annular bowl-shaped space or feed supply chamber 20. The radially inner ends of the longer bushings 24 project into the annular space 20 a greater distance from the internal surface 14 of the side wall 13 than the inner ends of the shorter bushings 22.

FIG. 3 is an enlarged sectional view of a side wall portion of the atomizer wheel 10 showing a build up of a relatively uniform thickness 30 of particles from the slurry of abrasive material along the inner surface 14 of the side wall 13. The relatively heavy particles comprising the layer 30 are thrown outwardly by centrifugal force developed during rotation of the atomizer wheel 10. The short nozzles 22 all protrude or project inwardly into the bowl-shaped space 20 an equal distance from the inner surface 14 of the side wall 13. The heavy particles comprising the layer 30 build up to a uniform thickness substantially equal to the distance the inner ends of the short bushings 22 project inwardly from the inner surface 14 of the side wall 13. This build up of the relatively heavy particles in the layer 30 provides an abrasion resistant layer which serves to protect the inner surface 14 of the side wall 13 from the undesirable abrasive action of the highly abrasive slurry provided to the bowl-shaped space 20. The particle layer 30 acts as a buffer or insulating layer protecting the side wall from abrasion in much the same manner that the annular insert 18 of wear-resistant material protects the bottom 11 from abrasion by the highly abrasive slurry.

Figure 4:
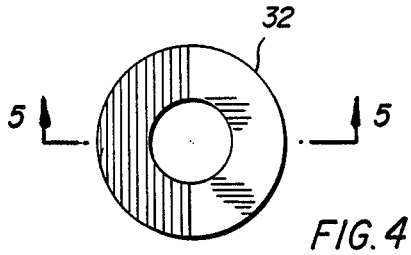
FIG. 4 is a plan view of an alternate bushing or nozzle insert according to the present invention.

FIGS. 4 and 5 depict an alternate bushing design according to the present invention. In FIGS. 4 and 5 the end of the bushing 32 which projects into the annular bowl-shaped space is stepped as shown at 34 and 36 so that the portion 34 projects into the bowl-shaped space a greater distance from the inner surface 14 of the side wall 13 than does the end portion 36. The stepped inner end of the alternate bushing 32 provides a portion 34 of the inner end of the bushing which projects radially inward further than the portion 36 and a corresponding portion 36 of other such nozzles in an atomizer wheel. The shorter inwardly projecting portion 36 determines the thickness of the protective layer 30 as shown in FIG. 5. Thus, as shown by FIGS. 4 and 5 the inwardly projecting end of a bushing or nozzle insert may be formed in such a manner to provide different effective inwardly projecting lengths at one end of a single bushing.

Figure 7:
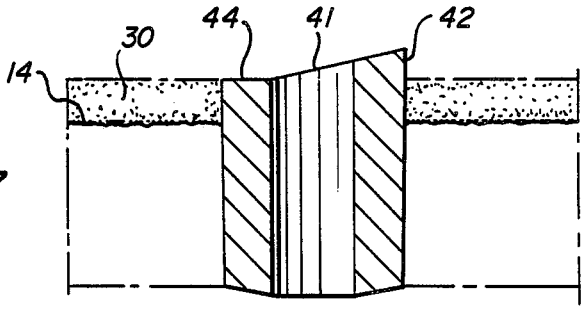
FIGS. 6–13 are plan and partial sectional views similar to FIGS. 4 and 5, but illustrate additional alternate bushings and/or nozzle inserts according to the present invention.
Figure 6:
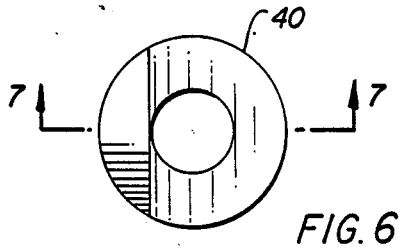

FIGS. 6 and 7 show a still further modified bushing design wherein the inwardly projecting end of a bushing 40 is tapered as shown at 41 so as to provide a portion 42 of the inwardly projecting end of the bushing 40 which extends a greater distance from the inner surface 14 of the side wall 13 than does the portion 44 at that end of the bushing. Here, as with the bushing 32, the shorter projecting portion 44 of the bushing 40 determines the thickness of the protective layer 30 of heavy particles.

Figure 9:
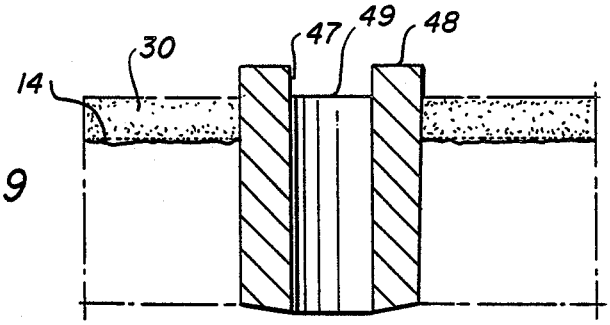
Figure 8:
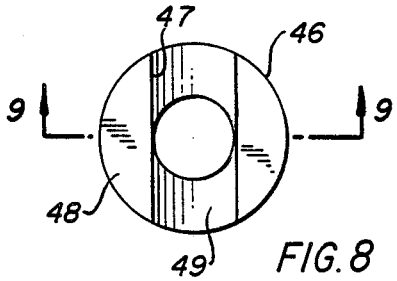

FIGS. 8 and 9 show a still further modified bushing 46 having an inwardly projecting end which is grooved or slotted at 47 to provide two portions 48 which project inwardly a greater distance from the inner surface 14 of side wall 13 than does the portion 49. Here, as in the embodiments illustrated in FIGS. 5 and 7 the end portion 49 determines the thickness of the protective layer 30.

Figure 11:
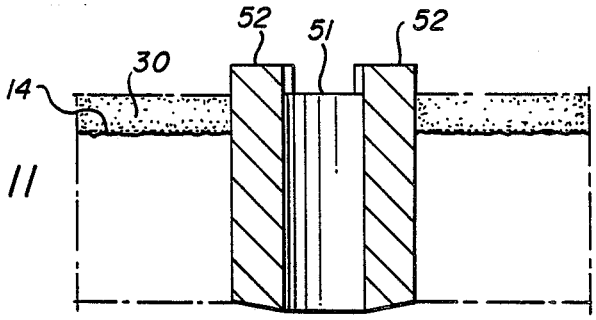
Figure 10:
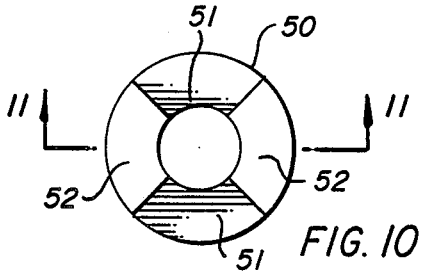

FIGS. 10 and 11 show an alternate bushing 50 having diametrically opposed flat sectors 51 separated by raised or extended surfaces 52 which project a greater distance internally of the inner surface 14 of side wall 13.

Figure 13:
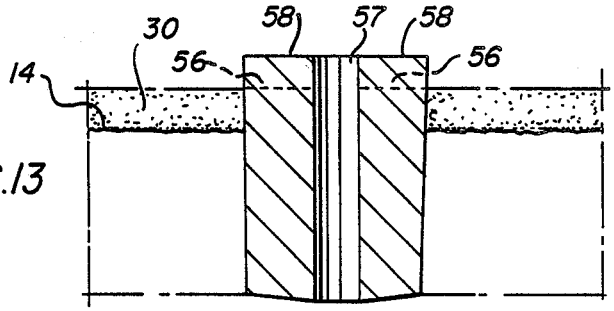
Figure 12:
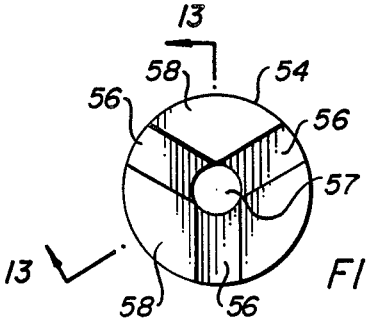

FIGS. 12 and 13 illustrate a still alternate bushing 54 wherein three slurry passages or grooves 56 are cut leading from the circumference of the bushing 54 to a through bore 57. The passages 56 are separated by raised or extended portions 58 which project into the bowl-shaped space a greater distance form the inner surface 14 of the side wall 13 than do the bottoms of the passages 56.

The improved capacity as well as the improved resistance to abrasion provided for an atomizer wheel constructed in accordance with the present invention will be illustrated by the following examples wherein wheel performance is measured in terms of maximum capacity. Maximum capacity as used herein is defined as that capacity measured in terms of weight or volume of feed material that can be atomized by a wheel being operated at a given revolution per unit time such that all material entering the wheel exits by way of the nozzles and none of the material overflows the atomizer wheel. In practice, it is sometimes difficult to determine the limit exactly until after the unit has been shut down for inspection and physical evidence of overflow can be observed. In operation, overflow may be indicated by product irregularities.

EXAMPLE 1

A clay slurry having a solids content of 56 percent was atomized by means of an atomizer wheel of the type shown in FIG. 1 with the exception that all nozzles projected inwardly from the inner wall of the wheel the same effective length of 5 mm as illustrated by the short nozzles 22. The outer diameter of the wheel was 240 mm and the number of ejection orifices or nozzles was 24, all of which were lined with inwardly projecting bushings of a wear-resistant material.

At a rotational velocity of 6400 rpm the maximum loading capacity of the wheel was measured at 19 cubic meters per hour. After 100 hours of operation, the unit was shut down and the wheel was examined to determine the extent of abrasion damage. Significant abrasive damage was observed in the vicinity of the nozzles. The sedimented surface protective layer 30 that tends to form on the inner surface of the wheel, as illustrated in FIG. 3, was apparently disrupted by turbulent flow at maximum loading thereby exposing the inner metal wall surface to abrasive action.

Thereafter, twelve of the nozzles were replaced by inwardly projecting solid plugs having the same diameter as the nozzles. The solid plugs extended 25 mm inwardly from the inner wall of the wheel. In operation these solid plugs served as paddles or projections to impart angular velocity to material before the material reached the inner wall of the wheel.

At the same rotational velocity of 6400 rpm the maximum capacity was measured at 31 cubic meters per hour. After 200 hours of operation the unit was shut down and the wheel was examined for abrasion damage. Negligible abrasion damage was observed. This test demonstrated that the inwardly protruding spoke-like plugs effectively accelerate the angular velocity of material entering the system thereby increasing wheel capacity even though only one-half as many nozzles were utilized.

Thereafter the twelve solid plugs were replaced by twelve long ejection bushings as illustrated in FIGS. 1–3. These bushings had the same diameter as the short bushings but extended inwardly from the inner surface of the wheel a distance of 25 mm.

Operations were resumed at 6400 rpm and the maximum capacity was found to be 45 cubic meters per hour. After 200 hours the unit was shut down for wheel examination. No appreciable abrasion damage was observed. This test demonstrated that the present invention provides an atomizer wheel having improved resistance to abrasion particularly when processing abrasive materials at high wheel loadings.

EXAMPLE 2

An atomizer wheel of the type illustrated in FIG. 1 but having a diameter of 280 mm's was used. Like Example 1, the - number of ejection nozzles was 24 all of which were made of bushings formed from a wear-resistant material. Further all 24 bushings extended inwardly from the inner wall of the wheel an equal distance of 5 mm.

At a rotational speed of 8800 rpm the maximum capacity when atomizing a highly abrasive and finely divided 42% solids titanium dioxide slurry was measured to be 10 cubic meters per hour. After 100 hours operation the unit was shut down for inspection. Abrasion damage was extensive indicating that the protective layer of sedimented material as illustrated in FIG. 3 was not coherent and that it was being disrupted by turbulent flow experienced at maximum capacity.

Twelve of the bushings were then removed in a symmetrical manner as illustrated in FIGS. 1 and 2 and replaced with bushings having a cut out or stepped end as illustrated in FIGS. 4 and 5. The cut out was such that one half of each of the twelve bushings extended inwardly 5 mm from the inner wall of the wheel and the other one-half extended inwardly 10 mm. In this test the bushings were inserted so that the one half of each nozzle extending inwardly 5 mm faced the material being accelerated.

At the same rotational velocity of 8800 rpm a maximum capacity of 20 cubic meters per hour was measured. After 100 hours operation the unit was shut down for inspection. Abrasion damage was negligible.

This test demonstrated that a single nozzle can be made to effectively protrude inwardly different distances as shown in FIG. 5 so as to obtain the benefits of abrasion resistance while operating at high wheel capacity.

EXAMPLE 3

A kaolin slurry having a nominal solids content of 45% solids was atomized by means of an atomizer wheel of the type shown in FIG. 1 with the exception that all of the 24 bushings projected inwardly from the inner wall of the wheel the same effective length of 5 mm. The outer diameter of the wheel was 350 mm. All bushings were made of a wear-resistant material.

A rotational velocity of 6000 rpm the maximum loading capacity of the wheel was reached at 44 tons which was less than the sought after wheel capacity of at least 50 tons per hour. After 100 hours operation the unit was shut down for inspection. A coherent solid cake approximately 5 mm thick had formed on the inner wall of the wheel. Abrasion damage was insignificant.

Thereafter all 12 of the bushings in the row nearest the bottom plate were removed and replaced with 12 bushings projecting inwardly a distance of 12 mm from the surface of the inner wall of the wheel. Operations were than resumed with the wheel running at a rotational velocity of 6000 rpm. The maximum wheel capacity was measured at 61 tons per hour. After 100 hours operation the unit was shut down for inspection.

A coherent solid deposit approximately 5 mm thick had formed on the inner wall of the wheel. Abrasion damage was insignificant.

EXAMPLE 4

A highly abrasive titanium dioxide slurry having a normal solids content of 45% solids was atomized by means of an atomizer wheel of the type shown in FIG. 1 with the exception that all of the 24 nozzles projected inwardly a distance of 5 mm from the inner wall of the wheel. The wheel had an external diameter of 225 mm.

The unit was operated for 100 hours at a rotational velocity of 8800 rpm and a feed rate of 18 tons per hour. The unit was then shut down for inspection. Severe damage was found particularly near the bushings facing the impact of material being accelerated to the rotational velocity of the wheel. A coherent protective coating of material did not form on the inner wall of the wheel presumable, at least in part, due to the finely divided nature of the titania and the extent of turbulence existent in the wheel.

Thereafter the 24 bushings forming the original nozzles were replaced with bushings extending inwardly 10 mm from the inner wall of the wheel and operations resumed at a wheel rotation of 8800 rpm feeding 18 tons per hour for 100 hours. Then the unit was shut down for inspection. Abrasion damage was insignificant around the nozzles. A protective layer of sedimented material approximately 10 mm thick had formed adjacent the inner wall of the wheel. Severe abrasion was found at the top cover plate of the wheel indicating over-flow conditions.

Thereafter 12 of the 10 mm inwardly projecting bushings were replaced with bushings that projected inwardly 5 mm. Operations were resumed at a rotational velocity of 8800 rpm. The maximum wheel capacity was found to be 25 tons per hour. After 100 hours operation the unit was shut down for inspection. A firm coherent protective layer of sedimented material had formed on the inner wall of the wheel. Abrasion damage was negligible. The unit was then put back in production service and subsequently shut down for inspection at 2 week intervals. After 6 weeks operation abrasion was not sufficient to require nozzle or wheel replacement.

Although specific embodiments of the invention and several modified nozzle designs incorporating different types of bushings have been disclosed, the present invention is not to be construed as limited to the particular embodiments and forms disclosed herein since the foregoing description is to be regarded as illustrative rather than restrictive and it should be understood that modifications and variations in details of construction may be made without departing from the spirit and scope of the invention as defined by the claims appended hereto.

What is claimed is:

1. An atomizer wheel for atomization of slurries comprising a hub adapted for connection to a rotating drive shaft, a bottom, a substantially cylindrical side wall and a cover plate defining an annular bowl-shaped space concentric with said hub, said side wall being formed with a plurality of openings and a plurality of nozzles formed of a wear-resistant material, each of said nozzles being inserted in one of said openings with one end projecting into said bowl-shaped space a distance from said side wall and at least one of said nozzles having at least a portion of said one end projecting into said bowl-shaped space a greater distance from said side wall than at least a portion of said one end of other ones of said nozzles.

2. An atomizer wheel as defined by claim 1, wherein each of said nozzles is comprised of a bushing formed of a wear-resistant material.

3. An atomizer wheel as defined by claim 1, wherein the entire one end of said at least one of said nozzles projects into said bowl-shaped space a greater distance from said side wall than said one end of other ones of said nozzles.

4. An atomizer wheel as defined by claim 3, wherein a predetermined number of said plurality of said nozzles have one end projecting into said bowl-shaped space a greater distance from said side wall than the other said nozzles and said predetermined number of said nozzles are inserted in openings equally spaced around said side wall.

5. An atomizer wheel as defined by claim 4, wherein said predetermined number of said plurality of nozzles comprise one-half of said plurality of nozzles.

6. An atomizer wheel as defined by claim 1, wherein said one end of at least one of said nozzles is formed so that one part of said one end of said at least one of said nozzles projects inward a greater distance than another part of said one end of said nozzle.

7. An atomizer wheel as defined by claim 6, wherein said one end of said at least one of said nozzles is stepped.

8. An atomizer wheel as defined by claim 6, wherein said one end of said at least one of said nozzles is at least partially tapered.

9. An atomizer wheel as defined by claim 6, wherein said one end of said at least one of said nozzles is recessed to provide at least one slurry passage leading from a circumferential portion of said one end to the interior of said at least one of said nozzles.

10. An atomizer wheel for atomization of slurries comprising a hub adapted for connection to a rotating drive shaft, a bottom, a substantially cylindrical side wall and a cover plate defining an annular bowl-shaped space concentric with said hub, said side wall being formed with a plurality of openings and a plurality of nozzles formed of a wear resistant material, each of said nozzles being inserted in one of said openings with one end projecting into said bowl-shaped space a distance from said side wall and at least one of said nozzles having one end projecting into said bowl-shaped space a greater distance from said side wall than the other said nozzles.

11. An atomizer wheel as defined by claim 10, wherein each of said nozzles is comprised of a bushing formed of a wear-resistance material.

12. An atomizer wheel as defined by claim 11, wherein a predetermined number of said plurality of said bushing have one end projecting into said bowl-shaped space a greater distance from said side wall than the other said bushings and said predetermined number of said bushings are inserted in openings equally spaced around said side wall.

13. An atomizer wheel as defined by claim 12, wherein said predetermined number of said plurality of bushings comprise one-half of said plurality of bushings.

14. A atomizer wheel as defined by claim 12, wherein said one end of each of said predetermined number of said plurality of said bushings projects into said bowl-shaped space a distance at least two times the distance the said one ends of the other said bushings project into said bowl-shaped space.

15. An atomizer wheel for atomization of slurries comprising a hub adapted for connection to a rotating drive shaft, a bottom, a substantially cylindrical side wall and a cover plate defining an annular bowl-shaped space concentric with said hub, said side wall being formed with a plurality of openings and a plurality of nozzles formed of a wear resistant material, each of said nozzles being inserted in one of said openings with one end projecting into said bowl-shaped space a distance from said side wall and at least one of said nozzles having one end projecting into said bowl-shaped space a distance from said side wall which is less than the distance the ends of other ones of said nozzles project into said bowl-shaped space.

16. An atomizer wheel as defined by claim 15, wherein each of said nozzles is comprised of a bushing and a predetermined number of said plurality of said bushings have one end projecting into said bowl-shaped space a distance from said side wall less than the distance the ends of said other ones of said bushings project and said predetermined number of said bushings are inserted in openings equally spaced around said side wall.

17. An atomizer wheel for atomization of slurries comprising a hub adapted for connection to a rotating drive shaft, a bottom and a substantially cylindrical side wall defining an annular bowl-shaped space concentric with said hub, said side wall being formed with a plurality of openings and a plurality of nozzles formed of a wear resistant material, each of said nozzles being inserted in one of said openings with one end projecting into said bowl-shaped space a distance from said side wall and one end of at least one of said nozzles is formed so that one part of said one end projects inward a greater distance from said side wall than another part of said one end of said nozzle.

18. An atomizer wheel as defined by claim 17, wherein each of said nozzles is comprised of a bushing formed of a wear-resistant material.

19. An atomizer wheel as defined by claim 18, wherein a predetermined number of said plurality of said bushings have one end formed so that one part projects into said bowl-shaped space a greater distance from said side wall than another part of said one end of said bushing and said predetermined number of said bushings are inserted in openings equally spaced around said side wall.

20. An atomizer wheel as defined by claim 19, wherein said predetermined number of said plurality of bushings comprise one-half of said plurality of bushings.

21. An atomizer wheel as defined by claim 17, wherein said one end of said at least one of said nozzles is stepped.

22. An atomizer wheel as defined by claim 17, wherein said one end of said at least one of said nozzles is at least partially tapered.

23. An atomizer wheel for atomization of slurries comprising a hub adapted for connection to a rotating drive shaft, a bottom, a substantially cylindrical side wall and a cover plate defining an annular bowl-shaped space concentric with said hub, said side wall being formed with a plurality of openings arranged in at least one circular row and a plurality of nozzles including at least one element formed of a wear resistant material, each of said nozzles being inserted in one of said openings with one end of each of said elements projecting into said bowl-shaped space a distance from said side wall and alternate ones of said elements having said one end projecting into said bowl-shaped space a greater distance from said side wall than said one ends of the other said elements.

24. An atomizer wheel as defined by claim 23, wherein said one end of said alternate ones of said elements project into said bowl-shaped space a distance at least two times the distance said one end of the other said elements project into said bowl-shaped space.

25. An atomizer wheel for atomization of slurries comprising a hub adapted for connection to a rotating drive shaft, a bottom, a substantially cylindrical side wall and a cover plate defining an annular bowl-shaped space concentric with said hub, said side wall being formed with a plurality of openings arranged in at least one circular row and a plurality of nozzles including at least one element formed of a wear resistant material, each of said nozzles being inserted in one of said openings with one end of each of said elements projecting into said bowl-shaped space a distance from said side wall and alternate ones of said elements have said one end formed so that one part of said one end projects inward a greater distance from said side wall than another part of said one end of said element.

26. An atomizer wheel as defined by claim 25, wherein said one end of said alternate ones of said elements is stepped and one part of said stepped end extends twice the distance from said side wall as another part of said stepped end of said alternate ones of said elements.

* * * * *